United States Patent [19]

Good

[11] Patent Number: 4,655,320

[45] Date of Patent: Apr. 7, 1987

[54] LADDER MEANS AND METHOD OF PRODUCTION

[75] Inventor: John C. Good, Rosslyn Park, Australia

[73] Assignee: Benboid Pty Ltd., Australia

[21] Appl. No.: 807,340

[22] Filed: Dec. 10, 1985

[30] Foreign Application Priority Data

Dec. 14, 1984 [AU] Australia ..... PG8586

[51] Int. Cl.[4] ..... E06C 7/08; E06C 7/50

[52] U.S. Cl. ..... 182/194; 182/228; 182/173

[58] Field of Search ..... 182/194, 228, 173, 174, 182/104

[56] References Cited

U.S. PATENT DOCUMENTS 3,005,513 10/1961 Larson ..... 182/165
3,638,759 2/1972 Engelhardt ..... 182/194
4,161,997 7/1979 Norman ..... 182/194
4,187,928 2/1980 Larson ..... 182/173

FOREIGN PATENT DOCUMENTS 615065 12/1948 United Kingdom ..... 182/173

*Primary Examiner*—Reinaldo P. Machado
*Attorney, Agent, or Firm*—Brown, Martin, Haller & Meador

[57] ABSTRACT

A ladder comprises a pair of spaced stiles, each having a channel shaped cross-section with the flanges of each stile directed towards those of the other, and a plurality of rungs interconnecting the stiles, each rung also being of general channel section, the tread portion of the rung defining an acute angle with one flange and an obtuse angle with the other flange, and weld beads joining the outer surface of the acute angled rung with one flange of each stile and the inner surface of the obtuse angle rung with the web of each stile.

7 Claims, 4 Drawing Figures

LADDER MEANS AND METHOD OF PRODUCTION

This invention relates to a welded ladder, and to the method of production of that ladder.

BACKGROUND OF THE INVENTION

It is already known to produce ladders by welding rungs between stiles, and in some instances the rungs are provided with treads. However the means and methods which have been utilised heretofore to produce, for example, aluminium ladders by welding, have been tedious and expensive, and an object of this invention is to provide improved means and method.

BRIEF SUMMARY OF THE INVENTION

A ladder comprises a pair of spaced stiles, each having a channel shaped cross-section with the flanges of each stile directed towards those of the other, and a plurality of rungs interconnecting the stiles, each rung also being of general channel section, the tread portion of the rung defining an acute angle with one flange and an obtuse angle with the other flange, and weld beads joining the outer surface of the acute angled rung with one flange of each stile and the inner surface of the obtuse angle rung with the web of each stile.

With this arrangement, the welds can be effected from one side only of a ladder assembly, and the production methods are therefore much simplified.

More specifically, a ladder according to this invention consists of a pair of spaced metal stiles, each having a channel shaped cross-section with the flanges of each stile directed towards the flanges of the other stile, a plurality of metal rungs between the stiles, each rung also being of channel section and having a tread portion flanked on each side by a respective rung flange, the tread portion of the rung defining an acute angle with one rung flange and an obtuse angle with the other rung flange, and weld beads joining the stiles to the outer surfaces of the acute angled rung flanges, and to the inner surfaces of the obtused angled rung flanges.

Further, in the invention a method of production of a ladder consists of forming said pair of ladder stiles and a plurality of said ladder rungs, clamping the stiles and rungs in a jig with the outer surfaces of the rung flanges contiguous with the inner surfaces of the stile flanges, arc welding the outer surfaces of said acute angled flanges of the rungs to the stiles, and also arc welding the inner surfaces of the obtuse angled rung flanges to the stiles, effecting both steps of said welding from one side only of the ladder. This method of production is suitable for automatic or semi-automatic welding, and results in a very strong fabrication.

DETAIL DESCRIPTION OF THE DRAWINGS

Figure 1:
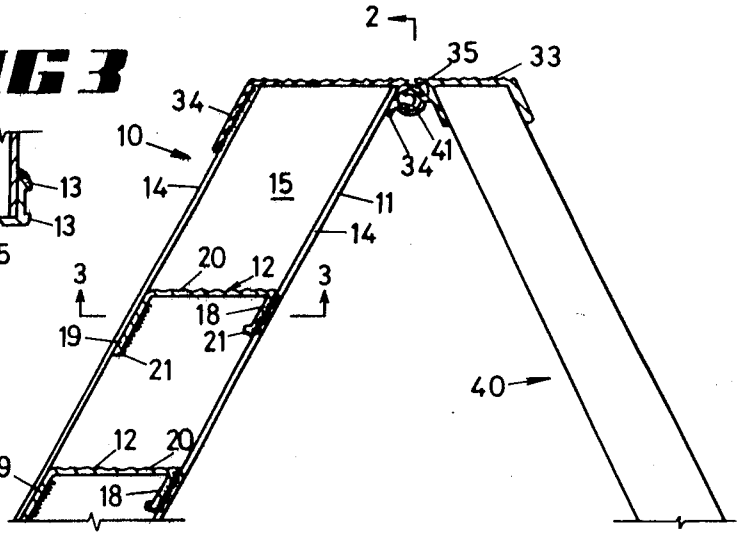
Figure 3:
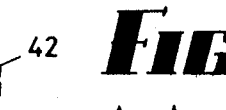
Figure 2:
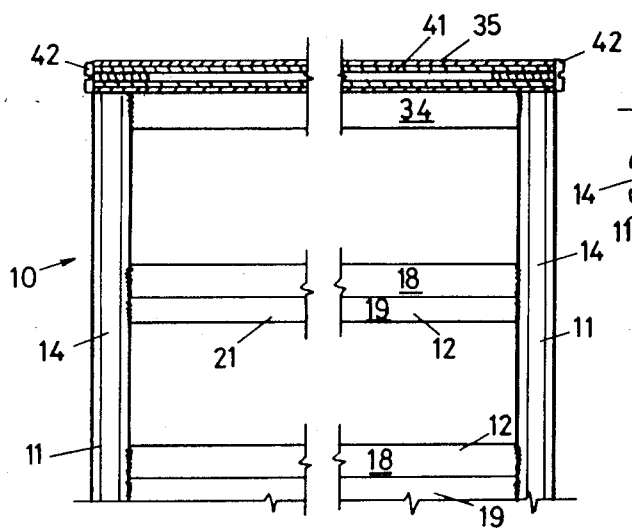
Figure 4:
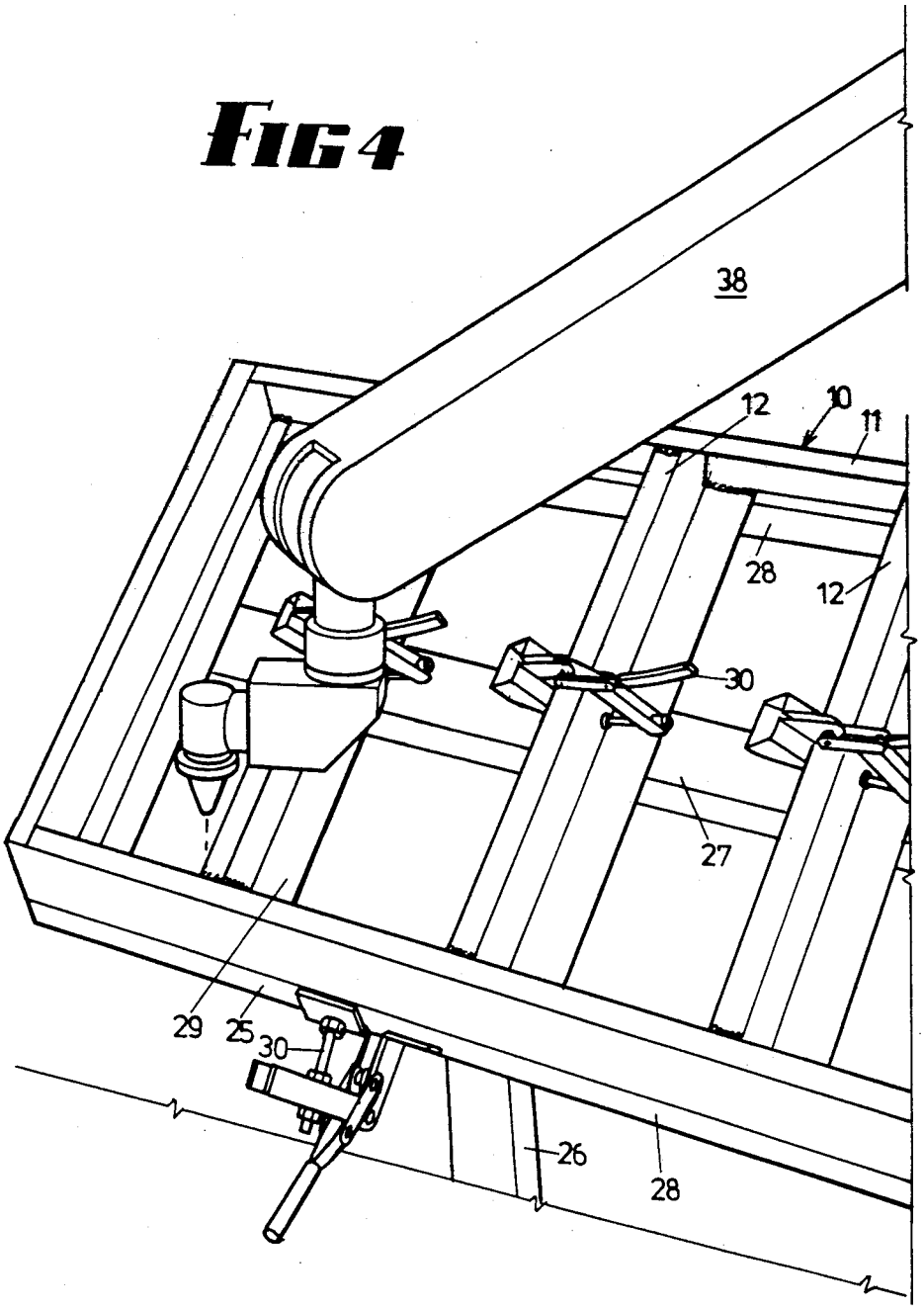

An embodiment of the invention is described hereunder in some detail with reference to, and is illustrated in, the accompanying drawings, in which FIG. 1 is a sectioned end elevation of the upper part of a ladder, FIG. 2 is a section taken on line 2—2 of FIG. 1, FIG. 3 is a section taken on line 3—3 of FIG. 1, and FIG. 4 is a perspective view which illustrates the means for protection.

A ladder 10 comprises a pair of extruded stiles 11 and between them a plurality of rungs 12, also of extruded metal. Although in this embodiment extrusile metal is used, quite obviously the invention can also be applied to rungs and stiles formed from folded or roll-formed sheet metal.

However where extrusile metal is used, the cross-section of each stile includes thicker portions 13 (FIG. 3) at the ends of the stile flanges 14 and at the corners between the flanges and the stile webs 15, and this has the dual effect of reducing weight and inreasing thickness at the location where welds are to take place. This increase of thickness is useful in assisting the achievement of a proper heat balance to get optimum weld conditions. The stile flanges 14 are parallel to one another and are at right angles to the stile webs 15.

The rung flanges 18 and 19 of each rung 12 are parallel to one another, but are angled so that the tread 20 between them is horizontal when the stiles are angled as in ordinary use. Thus flange 18 is hereincalled an "acute angled flange" and defines an angle of about 67° with the tread 20 and the other (the obtuse angled flange 19), an angle of about 113°. The upper surface tread 20 comprises ribs to reduce hazard. The ends of each flange 18 and 19 terminate in respective beads 21, and the joins between the flanges and tread are of curved or arcuate shape. The ends of the rung flanges are also thicker than the remainder of the flanges.

A jig 25 (FIG. 4) which is employed to clamp the parts in position comprises a frame 26 having one central longitudinal member 27, and two side longitudinal members 28 and cross members 29 joining them. The longitudinal members all lie in a single plane which is however inclined to the horizontal. The side longitudinal members 28 comprise clamping channels along each side which accept the stiles 11 over the flanges of rungs 12, and clamps 30 clamp them thereto. The central longitudinal member also has a plurality of clamps 30 which clamp respective rungs 12 in their required position. Because of the inclination of the rung flanges to the treads between them, there is a simple access for welding the rear as well as the top flanges. The rear flanges 19 are the obtuse angle flanges and the top flanges 18 the acute angle flanges.

Besides the rungs between the stiles, in this embodiment the ladder is provided with an upper rung or platform 33, and this is wider than the intermediate rungs, the flanges 34 of the upper rung overlapping the flanges of the stiles. One of the flanges 34 of the upper rung 12 is comparatively short and has projecting from it a C-section hinge portion 35.

After all the parts of the ladder have been clamped into position, a welding machine 38 is employed to effect a plurality of arcwelds (or spotwelds in the case of sheet metal being used) and since the flanges of both rungs and stiles are stiffened by the beads along the edges, a single weld between each rung flange and the stile at each end will result in a very rigid and reliable structure. The inclination of jig 25 facilitates the welds, more easily accommodating the requirements of the machine 38 which is of the "robot" type. In the case of the acute angle flanges 18, the welds are between the outer surfaces of those flanges and the outer edges of the stile flanges 14. However, the welds between the obtuse angle flanges 29 and the stiles are between the end edges of the flanges and the webs 15 of the stiles 11. While the machine illustrated for welding is a "robot arm" type machine, quite clearly other automatic or special purpose machines may be utilised.

The above description of the preferred embodiment is directed to a single ladder portion 40. However quite frequently there are required to be two ladder portions hinged with respect to one another so as to make a step ladder usable from either one of two sides. The second ladder portion 40 is formed in the same way as the first ladder portion, and is interconnected by a C-section hinge portion 41 which lies in the similar, but larger, C-section hinge portion 35 of the first portion, and is retained therein by end screws 42 which threadably engage the inner surfaces of the smaller diameter C-section portion, the heads of the screws bearing against washers which in turn bear against the ends of the platform portions and inhibit relative axial displacement.

One of the problems which has been encountered heretofore has been to provide a foot for a ladder which is substantial and stiff, but nevertheless has sufficient resilience to firmly grip a substrate.

Previously fabricated ladders have employed feet which clamp over vertical surfaces, but distortion sometimes make such feet somewhat unsafe.

In this embodiment, however, a short length of strip metal abuts the lower end of each stile, and is secured thereto by welds between the strip metal and the stile web, and between the strip metal and one at least of the stile flanges. This provides a base to which a rubber foot can be clamped with fasteners. A safer and better condition then exists for supporting the ladder feet under adverse conditions. (This feature is not herein illustrated).

I claim:

1. A ladder comprising a pair of spaced metal stiles, each having a channel shaped cross-section with a web and a pair of flanges, said flanges of each stile directed towards the flanges of the other stile, a plurality of metal rungs between the stiles, each rung also being of channel section and having a tread portion flanked on each side by a respective rung flange, the tread portion of each said rung defining an acute angle with one said rung flange and an obtuse angle with the other said rung flange, the ends of said rung flanges lying between, and contiguous with inner surfaces of, said stile flanges, and weld beads joining the outer surface of each said acute angled rung flange to one of the flanges of each respective said stile and the inner surface of each end of each said obtused angled rung flanges to an inner surface of a respective said stile web.

2. A ladder according to claim 1 wherein said stiles are extruded aluminium and thicker at the ends of the flanges and at the corners between webs and flanges than between those said areas, and also wherein said rungs are extruded aluminium and the ends of the rung flanges are thicker than the remainder.

3. A ladder according to claim 1 wherein said weld beads are the only joining means between the stiles and rungs.

4. A ladder according to claim 1 further comprising a platform at its upper end which also has a channel-shaped cross-section including an intermediate platform portion flanked along its sides respectively with an acute angled flange and an obtuse angled flange, the flanges of the platform portion overlying the flanges of the stiles at their upper ends.

5. A ladder according to claim 4 wherein the platform acute angled flange also includes a hinge portion of 'C' shaped cross-section, the ladder comprising a second ladder portion also having a platform at its upper end of similar cross-sectional shape to the first said platform but of smaller size, and the outer surfaces of the 'C' section hinge portion of the second ladder portion slidably engage the inner surfaces of the first said 'C' section hinge portion to form a hinge at the upper end of the ladder, and further comprising screws in the ends of the hinge portions retaining assembly.

6. A method of production of a ladder comprising forming a pair of ladder stiles to a channel section shape having a web flanked by a pair of flanges, forming a plurality of ladder rungs each to a channel section shape and each having a web flanked by an acute angle flange and an obtuse angle flange, clamping the stiles and rungs in a jig with the outer surfaces of the rung flanges contiguous with the inner surfaces of the stile flanges, and arc welding the outer surfaces of said acute angled flanges of the rungs to the stile flanges, and also arc welding the inner surfaces of the obtuse angled rung flanges to the stile webs, effecting both steps of said welding from one side only of the ladder.

7. A method of production of a ladder according to claim 6 comprising extruding aluminum, and cutting the extruded aluminum, to form said stiles and rungs, and extruding and cutting further aluminum to form a platform with a web flanked by flanges, effecting said clamping of the stiles and rungs in said jig, and effecting said arc welding of said acute flanges of the rungs to the stiles, and clamping the platform in the jig with the platform flanges overlying the stile flanges, and arc welding the inner surfaces of the platform flanges to the stile flanges from the same said side of the ladder.

* * * * *